US006409470B2

(12) United States Patent
Allford et al.

(10) Patent No.: US 6,409,470 B2
(45) Date of Patent: Jun. 25, 2002

(54) TIP TREATMENT BARS IN A GAS TURBINE ENGINE

(75) Inventors: Peter Allford; Mark J. Houle, both of Bristol (GB)

(73) Assignee: Rolls-Royce, PLC, London (GB)

( * ) Notice: Subject to any disclaimer, the term of this patent is extended or adjusted under 35 U.S.C. 154(b) by 0 days.

(21) Appl. No.: 09/854,593

(22) Filed: May 15, 2001

(30) Foreign Application Priority Data

Jun. 6, 2000 (GB) ..... 0013772

(51) Int. Cl.[7] ..... F01D 25/04

(52) U.S. Cl. ..... 415/119; 415/58.5; 415/58.7; 415/914

(58) Field of Search ..... 415/914, 119, 415/220, 221, 58.5, 58.7, 57.1, 57.3, 173.1

(56) References Cited

U.S. PATENT DOCUMENTS 4,212,585 A * 7/1980 Swarden et al. ..... 415/198.1
4,781,530 A * 11/1988 Lauterbach et al. ..... 415/173.1
4,990,053 A * 2/1991 Rohne ..... 415/143
5,137,419 A * 8/1992 Waterman ..... 415/170.1
5,762,470 A * 6/1998 Gelmedov et al. ..... 415/119

FOREIGN PATENT DOCUMENTS

| | | |
|---|---|---|
| GB | 2 344 140 A | 5/2000 |
| WO | WO 94/20759 | 9/1994 |

* cited by examiner

*Primary Examiner*—F. Daniel Lopez
*Assistant Examiner*—Igor Kershteyn
(74) *Attorney, Agent, or Firm*—Oliff & Berridge, PLC

(57) ABSTRACT

A gas turbine engine casing includes a tip treatment ring 20 which comprises end supports 18 which support tip treatment bars 16. Each tip treatment bar 16 is mounted at its ends within the respective end supports 18 by damping elements 22, which isolate the bar 16 from the end supports 18. The elements 22 damp vibrations induced in the tip treatment bars 16 so inhibiting the initiation of high cycle fatigue cracking.

27 Claims, 2 Drawing Sheets

TIP TREATMENT BARS IN A GAS TURBINE ENGINE

FIELD OF THE INVENTION

This invention relates to tip treatment bars of a rotor casing for a gas turbine engine.

DESCRIPTION OF THE PRIOR ART

WO94/20759 discloses an anti-stall tip treatment means in a gas turbine engine, in which an annular cavity is provided adjacent the blade tips of a compressor rotor. The cavity communicates with the gas flow path through the compressor past a series of bars extending across the mouth of the cavity.

Such tip treatments are applicable to both fans and compressors of gas turbine engines, and their purpose is to improve the blade stall characteristics or surge characteristics of the compressor.

The passage of the blade tips past the bars creates vibrations in the bars which, over time, can result in high cycle fatigue failure of the bars. This failure is caused by vibration resonance between the tip treatment bars and the natural engine order modes.

It is an object of the present invention to reduce or eliminate high cycle fatigue failure in tip treatment bars of a gas turbine engine.

It is a further object of the present invention to reduce or eliminate vibration resonance between tip treatment bars of a gas turbine engine and natural engine order modes.

It is a yet further object of the present invention to isolate tip treatment bars of a gas turbine engine from end supports by which they are supported.

It is a yet further object of the present invention to provide damping means between the tip treatment bars and the end supports.

SUMMARY OF THE INVENTION

According to one aspect of the present invention, there is provided a gas turbine engine casing comprising tip treatment bars extending between annular end supports, each tip treatment bar being supported at each end by the end supports and being isolated, at at least one end, from the respective end support by damping means.

In a preferred embodiment in accordance with the present invention, both ends of each tip treatment bar are isolated by damping means from the respective end support. The damping means may comprise a damping material, and preferably a damping material having a high degree of damping at higher frequencies (i.e. frequencies in excess of 1000 Hz).

The damping may be a polymer, and preferably an elastomeric polymer. Silicone elastomers may be used, for example the silicone elastomer available under the name SILASTIC J.

Preferably, the tip treatment bars or the end supports, or both, are bonded to the damping material, for example by means of a silicone adhesive. A suitable adhesive is that available under the name SILCOSET 152.

The damping material may comprise a moulded component which is assembled, after manufacture, with the tip treatment bars and the end supports. Alternatively, the damping material may be moulded in situ as the tip treatment bars are fitted to the end supports.

The bars may be solid, but they may alternatively be hollow, or provided with pockets, to lighten the structure.

The bars may be made from any suitable material, for example from alloys commonly used in the aircraft industry. In a preferred embodiment, the tip treatment bars and, preferably, the end supports are made from a composite material such as a carbon fibre/bismaleimide composite.

DETAILED DESCRIPTION OF A PREFERRED EMBODIMENT

Figure 1:
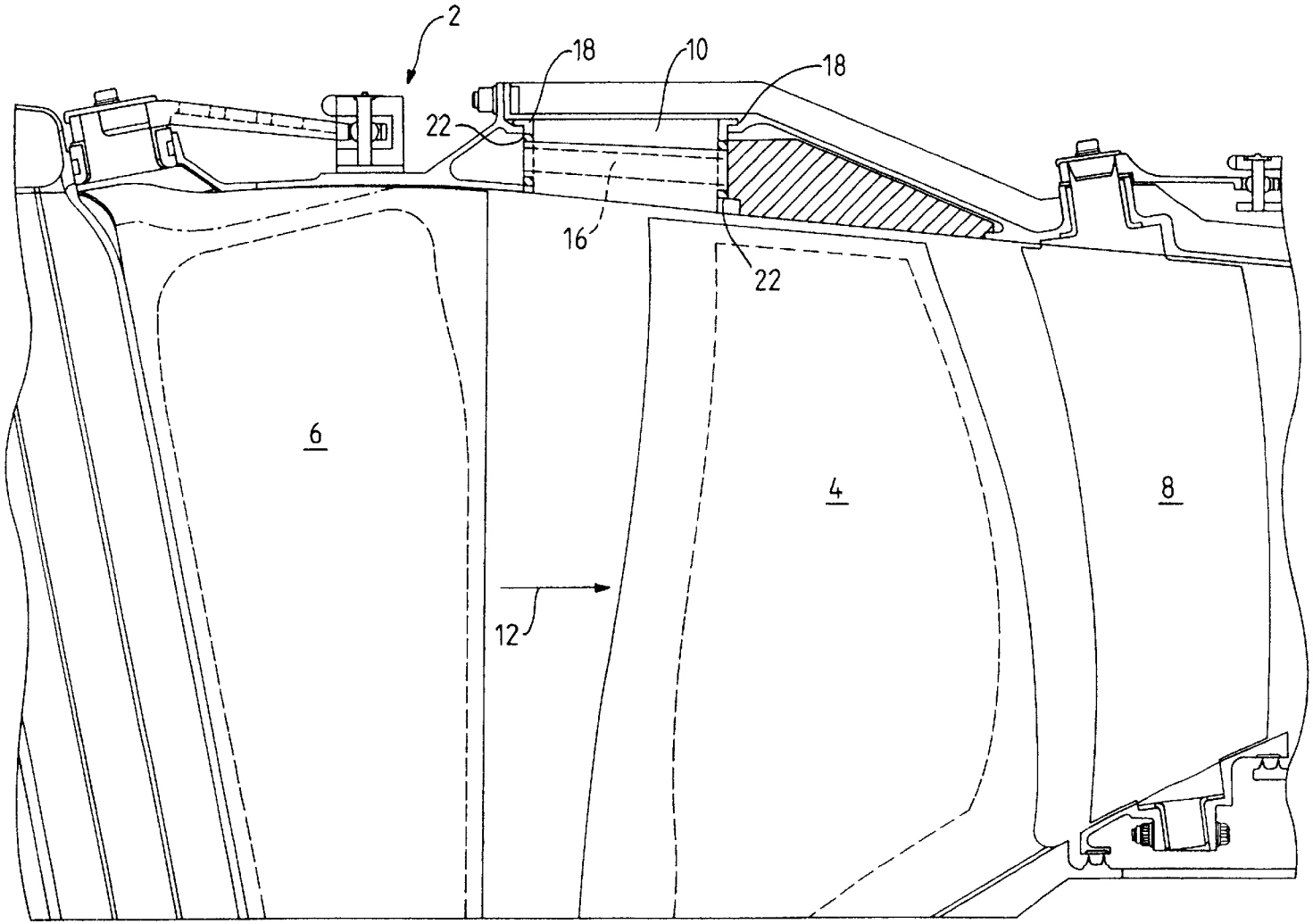
FIG. 1 is a partial axial sectional view of a fan stage in a gas turbine engine.

FIG. 1 represents a fan casing 2 of a gas turbine engine. A fan, represented by a single blade 4, is mounted for rotation in the casing 2. Guide vanes 6 and 8 are provided upstream and downstream, respectively, of the fan 4. The casing 2 includes a circumferentially extending chamber 10, which communicates with the main gas flow through the fan (represented by an arrow 12) through an array of slots 14 defined between tip treatment bars 16 disposed around the casing. The function of the chamber 10 in delaying the onset of stalling of the blades 4 is disclosed in International Patent Publication WO94/20759.

Figure 2:
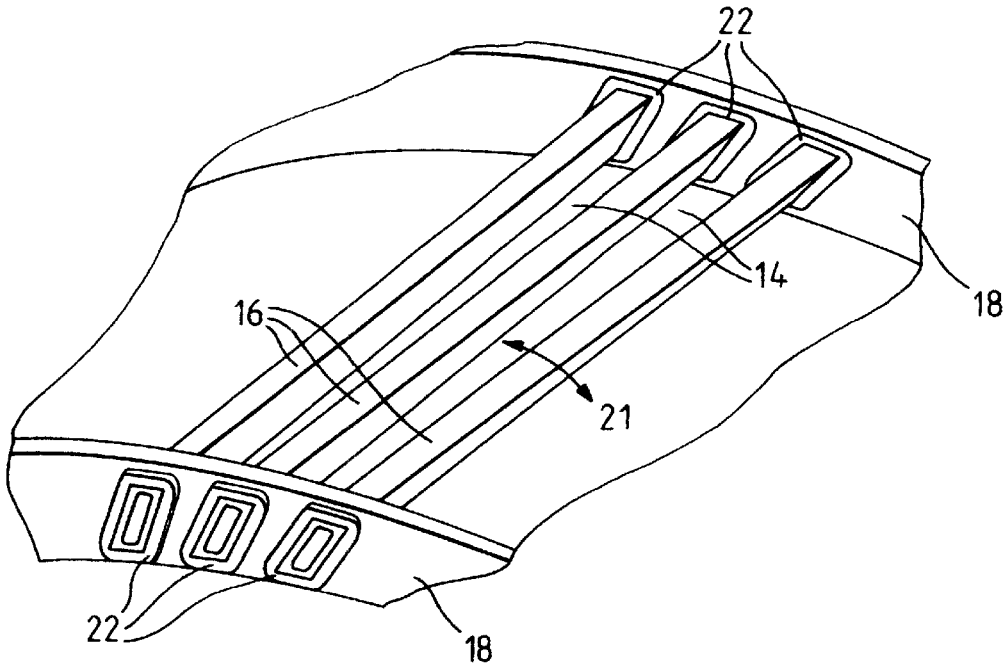
FIG. 2 is a view of tip treatment bars suitable for use in the engine of FIG. 1.
Figure 3:
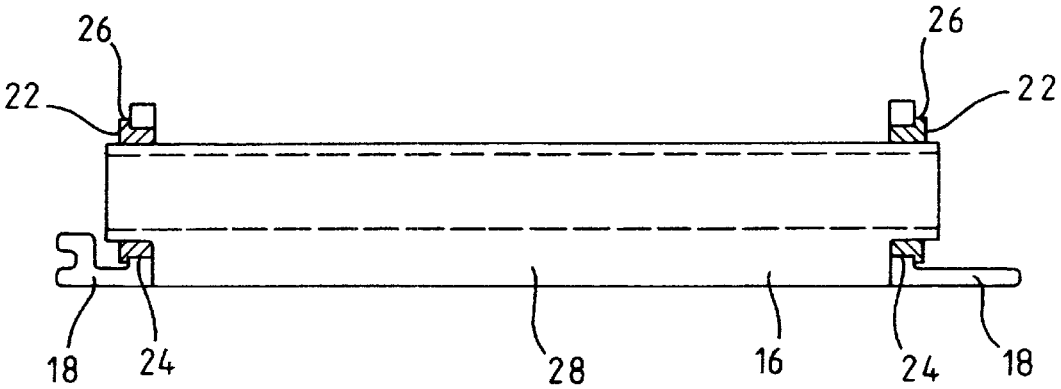
FIG. 3 is a sectional view of a single tip treatment bar.

The tip treatment bars 16 are supported by annular end supports 18 to provide a tip treatment ring 20 which is fitted within the casing 2 and extends around the fan 4. In the embodiments of FIGS. 1 to 3, the end supports 18 and the bars 16 are separate components made from a carbon fibre/bismaleimide composite material, which enables the tip treatment ring to be light in weight while being capable of withstanding the relatively high temperatures (in excess of 200° C.) encountered in operation. However, in other embodiments the end supports may be integral with adjacent parts of the casing 2.

Vibration is induced in the bars 16 in operation of the engine at a frequency determined by the passage of the blades 4. This vibration in a solid construction can lead to fatigue failure of the bars 16. The vibrating bars 16 deflect in a generally circumferential direction as indicated diagrammatically in FIG. 2 by an arrow 21, and consequently fatigue failure tends to be initiated by cracking at the slot ends.

The bars 16 are formed separately from the end support 18. Damping means is provided in the form of damping elements or boots 22 of damping material. The boots 22 isolate each end of each tip treatment bar 16 from the respective end support 18. For this purpose, each end support 18 has an array of openings 24 which have generally the same shape as the cross-section of the tip treatment bars 16, but is substantially larger. The space between each tip treatment bar 16 and the wall of the opening 24 is filled by the damping material of the boot 22. As shown in FIG. 3, each boot 22 has a flange 26 which extends for a short distance over the face of each end support 18 facing away from the other end support 18. This flange 26 serves to locate the boot 22 against the end support 18.

Each boot 22 may be formed as a separate component before assembly with its respective tip treatment bar 16 and the end supports 18. Alternatively, the boots may be formed by moulding the damping material in situ between the tip treatment bar 16 and the end support 18, in a potting process. The boots 22 are bonded to the respective bars 16 and end supports 18 by means of a suitable adhesive, such as a silicone adhesive as is available under the name SILCOSET 152. The damping material itself is a silicone elastomer, such as the material available under the name SILASTIC J.

As shown in FIG. 3, the tip treatment bar 16 is hollow along its length and includes a lateral, radially inwardly directed, extension 28 along most of its length.

In operation, the vibration induced in the bars 16 is effectively damped by the damping material of the boots 22. Thus, the amplitude of vibration is reduced, so inhibiting the initiation and propagation of high cycle fatigue cracking.

Additionally, the construction shown in the drawings enables the use of relatively frangible tip treatment bars 16. This frangibility is assisted by making the bars 16 hollow, as shown in FIG. 3, or relatively thin, and of a suitable frangible material. The use of frangible tip treatment bars allows a released portion of aerofoil to pass more easily into the cavity, thus minimising consequential damage to further blade stages or to the casing 2. The blade or fragment may be ejected past the tip treatment bars into the chamber 10, or may be held by the bars themselves, so preventing it from reaching the later compressor or turbine stages.

We claim:

1. A gas turbine engine casing comprising:

oppositely disposed annular end supports;

a plurality of tip treatment bars having opposite ends, each bar being supported at each end by the end supports; and damping means provided at at least one end of each bar, the damping means isolating the bar from the respective end support.

2. A gas turbine engine casing as claimed in claim 1, in which damping means are provided at both ends of each bar, thereby to isolate each tip treatment bar from the respective end supports at both ends.

3. A gas turbine engine casing as claimed in claim 1, in which the damping means comprise a damping element situated between each tip treatment bar and the respective end support.

4. A gas turbine engine casing as claimed in claim 3, in which the end supports are provided with openings within which the tip treatment bars are disposed, each damping element being provided between a respective one of the tip treatment bars and a wall of the respective opening.

5. A gas turbine engine casing as claimed in claim 3, in which the damping elements are formed from an elastomer.

6. A gas turbine engine casing as claimed in claim 5, in which the elastomer is a silicone elastomer.

7. A gas turbine engine casing as claimed in claim 3, in which an adhesive is provided between each tip treatment bar and the respective damping element.

8. A gas turbine engine casing as claimed in claim 7, in which the adhesive is a silicone adhesive.

9. A gas turbine engine casing as claimed in claim 3, in which an adhesive is provided between the respective damping element and each end support.

10. A gas turbine engine casing as claimed in claim 9, in which the adhesive is a silicone adhesive.

11. A gas turbine engine casing as claimed in claim 1, in which each tip treatment bar is hollow.

12. A gas turbine engine casing as claimed in claim 1, in which each tip treatment bar includes a pocket.

13. A gas turbine engine casing-as claimed in claim 1, in which each tip treatment bar is made from a carbon fibre/bismaleimide composite material.

14. A gas turbine engine casing as claimed in claim 1, in which each end support is made from a carbon fibre/bismaleimide composite material.

15. A gas turbine engine casing comprising:

oppositely disposed annular end supports provided with openings;

a plurality of tip treatment bars having opposite ends which are disposed within the respective openings of the end supports; and an elastomeric damping element provided at each end of each bar, each damping element being provided between a respective one of the tip treatment bars and the wall of the respective opening in the adjacent end support, the damping elements thereby isolating the bar from the end supports.

16. A gas turbine engine casing as claimed in claim 15, in which an adhesive is provided between each tip treatment bar and the respective damping element.

17. A gas turbine engine casing as claimed in claim 16, in which the adhesive is a silicone adhesive.

18. A gas turbine engine casing as claimed in claim 15, in which an adhesive is provided between the respective damping element and each end support.

19. A gas turbine engine casing as claimed in claim 18, in which the adhesive is a silicone adhesive.

20. A gas turbine engine casing as claimed in claim 15, in which each damping element comprises a moulded component fitted between each tip treatment bar and the respective end support.

21. A gas turbine engine casing as claimed in claim 15, in which each damping element is formed in situ between each tip treatment bar and the respective end support.

22. A gas turbine engine casing as claimed in claim 15, in which each damping element surrounds the respective end of the respective bar, and comprises a flange engaging a face of the respective end support.

23. A gas turbine engine casing as claimed in claim 15, in which each tip treatment bar is hollow.

24. A gas turbine engine casing as claimed in claim 15, in which each tip treatment bar includes a pocket.

25. A gas turbine engine casing as claimed in claim 15, in which each tip treatment bar is made from a carbon fibre/bismaleimide composite material.

26. A gas turbine engine casing as claimed in claim 15, in which each end support is made from a carbon fibre/bismaleimide composite material.

27. A gas turbine engine including an engine casing which comprises:

oppositely disposed annular end supports provided with openings;

a plurality of tip treatment bars having opposite ends which are disposed within the respective openings of the end supports; and an elastomeric damping element provided at each end of each bar, each damping element being provided between a respective one of the tip treatment bars and a wall of the respective opening in the adjacent end support, the damping elements thereby isolating the bar from the end supports.

* * * * *